US005921852A

United States Patent [19]

Kimura et al.

[11] Patent Number: 5,921,852

[45] Date of Patent: Jul. 13, 1999

[54] POLISHING APPARATUS HAVING A CLOTH CARTRIDGE

[75] Inventors: Norio Kimura; You Ishii, both of Fujisawa, Japan

[73] Assignee: Ebara Corporation, Tokyo, Japan

[21] Appl. No.: 08/880,639

[22] Filed: Jun. 23, 1997

[30] Foreign Application Priority Data

Jun. 21, 1996 [JP] Japan ..... 7-181471

[51] Int. Cl.[6] ..... B24B 5/00; B24B 29/00

[52] U.S. Cl. ..... 451/285; 451/289; 451/494

[58] Field of Search ..... 451/288, 285, 451/286, 287, 289, 290, 294, 158, 488, 548, 550, 53, 449, 494, 41, 42, 63, 526, 529, 539, 921

[56] References Cited

U.S. PATENT DOCUMENTS

| | | | |
|---|---|---|---|
| 3,932,966 | 1/1976 | Stern | 51/356 |
| 4,350,497 | 9/1982 | Ogman | 51/296 |
| 4,527,358 | 7/1985 | Day | 51/287 |
| 4,918,872 | 4/1990 | Sato et al. . | |
| 5,400,547 | 3/1995 | Tanaka et al. | 451/287 |
| 5,679,064 | 10/1997 | Nishi et al. . | |
| 5,704,827 | 1/1998 | Nishi et al. | 451/285 |

FOREIGN PATENT DOCUMENTS

| | | |
|---|---|---|
| 0706856 | 4/1996 | European Pat. Off. . |
| 195 38 991 | 5/1996 | Germany . |
| 96/07508 | 3/1996 | WIPO . |

OTHER PUBLICATIONS

U.S. Patent Application Serial No. 08/544,534, filed Oct. 18, 1995, Toyomi Nishi et al., entitled "Polishing Apparatus Including Cloth Cartridge Connected To Turntable", located in Group Art Unit 3203—Issue Fee Paid Feb. 14, 1997.

*Primary Examiner*—Timothy V. Eley
*Assistant Examiner*—Derris Holt Banks
*Attorney, Agent, or Firm*—Wenderoth, Lind & Ponack, LLP

[57] ABSTRACT

A polishing apparatus such as a semiconductor wafer. The polishing apparatus has a turntable, a cloth cartridge detachably exchangeably mounted on the turntable, and a top ring for holding a workpiece and pressing the workpiece against the polishing cloth. The cloth cartridge includes a cartridge base member and a polishing cloth bonded to an upper surface of the cartridge base member. The cartridge base member comprises a plurality of base member segments, and the polishing cloth comprises a plurality of polishing cloth segments bonded to upper surfaces of respective of the base member segments.

18 Claims, 3 Drawing Sheets

POLISHING APPARATUS HAVING A CLOTH CARTRIDGE

BACKGROUND OF THE INVENTION

1. Field of the Invention

The present invention relates to a polishing apparatus for polishing a workpiece such as a semiconductor wafer, and more particularly to a polishing apparatus having a cloth cartridge which is detachably exchangeably mounted on a turntable.

2. Description of the Related Art

Recent rapid progress in semiconductor device integration demands smaller and smaller wiring patterns or interconnections and also narrower spaces between interconnections which connect active areas. One of the processes available for forming such interconnections is photolithography. Though the photolithographic process can form interconnections that are at most 0.5 $\mu$m wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus, and such a process is called Chemical Mechanical Polishing (CMP) in which the semiconductor wafers are chemically and mechanically polished while supplying an abrasive liquid comprising abrasive grains and chemical solution such as alkaline solution.

Conventionally, a polishing apparatus has a turntable and a top ring which rotate at respective individual speeds. A polishing cloth is attached to the upper surface of an turntable. A semiconductor wafer to be polished is placed on the polishing cloth and clamped between the top ring and the turntable. An abrasive liquid containing abrasive grains is supplied onto the polishing cloth and retained on the polishing cloth. During operation, the top ring exerts a certain pressure on the turntable, and the surface of the semiconductor wafer held against the polishing cloth is therefore polished by a combination of chemical polishing and mechanical polishing to a flat mirror finish while the top ring and the turntable are rotated.

After, for example, one or more semiconductor wafers have been polished, the polishing cloth is processed to recover its original polishing capability. Various processes have been and are being developed for restoring the polishing cloth, and are collectively called "dressing". The polishing cloth is dressed by a dressing tool in order to enable the polishing apparatus to perform a good polishing function at all times without undesired degradation of polishing performance.

That is, a number of polishing processes are performed on the polishing cloth and a number of dressing processes are applied to the dressing cloth and thus cause the polishing cloth to be worn down, and hence the polishing cloth has to be replaced with a new one periodically. When replacing the polishing cloth, the polishing apparatus is shut down, and the polishing cloth is detached from the turntable. Thereafter, abrasive liquid remaining on the turntable is washed out, and a new polishing cloth is attached to the turntable after drying the turntable. This maintenance operation is troublesome and requires a long period of time during which the polishing apparatus continues to be shut down, thus lowering the productivity of the semiconductor devices per unit time.

In order to solve the above problems, there has been proposed a cloth cartridge which is detachably exchangeably mounted on the turntable. When a polishing cloth is worn down and required to be replaced, the cloth cartridge which has a polishing cloth mounted on a base plate and can be easily detached from the turntable is replaced with a new one which can be easily mounted on the turntable. Thus, the time required for replacement of the polishing cloth is relatively short, and the time that the polishing apparatus apparatus is shut down can be shortened to thus increase the productivity of the semiconductor devices per unit time.

However, the conventional cloth cartridge has a relatively large outer diameter and is difficult to handle. To be more specific, the cloth cartridge normally has a diameter of 600 mm or more, and hence the replacement of the cloth cartridge involves removal of a disk-shaped object having a diameter of 600 mm or more from the polishing apparatus. In many cases, the polishing apparatus is installed in a clean room, an(i when the cloth cartridge is replaced, the polishing cloth is normally wet with an abrasive liquid and such condition of the polishing cloth is not suitable for the environment of the clean room. In order to prevent the cloth cartridge from being exposed to the environment of the clean room, the cloth cartridge is packed in a bag or wrapped by a sheet inside the polishing apparatus, and then the packed or wrapped cloth cartridge is taken out from the polishing apparatus. In this case, since the cloth cartridge has a large diameter and the operation of replacement of the cloth cartridge has to be performed in a narrow space in the polishing apparatus, handling of the cloth cartridge is troublesome and the replacement operation is time-consuming.

SUMMARY OF THE INVENTION

It is therefore an object of the invention to provide a polishing apparatus having a cloth cartridge which can be easily handled when replacing the cloth cartridge.

According to one aspect of the present invention, there is provided a polishing apparatus for polishing a surface of a workpiece, comprising: a turntable; a cloth cartridge detachably exchangeably mounted on said turntable, said cloth cartridge including a cartridge base member and a polishing cloth bonded to an upper surface of said cartridge base member; and a top ring for holding the workpiece and pressing the workpiece against said polishing cloth; wherein said cartridge base member comprises a plurality of base member segments, and said polishing cloth comprises a plurality of polishing cloth segments bonded to upper surfaces of said base member segments, respectively.

According to another aspect of the present invention, there is provided a polishing apparatus for polishing a surface of a workpiece, comprising: a turntable; a cloth cartridge detachably exchangeably mounted on said turntable, said cloth cartridge including a cartridge base member and a polishing cloth bonded to an upper surface of said cartridge base member; and a top ring for holding the workpiece and pressing the workpiece against said polishing cloth; wherein said cartridge base member comprises a plurality of base member segments, and said polishing cloth comprises a sheet of polishing cloth bonded to upper surfaces of said base member segments.

The above and other objects, features, and advantages of the present invention will become apparent from the following description when taken in conjunction with the accompanying drawings which illustrate preferred embodiments of the present invention by way of examples.

DETAILED DESCRIPTION OF THE PREFERRED EMBODIMENTS

A polishing apparatus according to an embodiment of the present invention will be described below with reference to FIGS. 1 through 2B.

Figure 1:
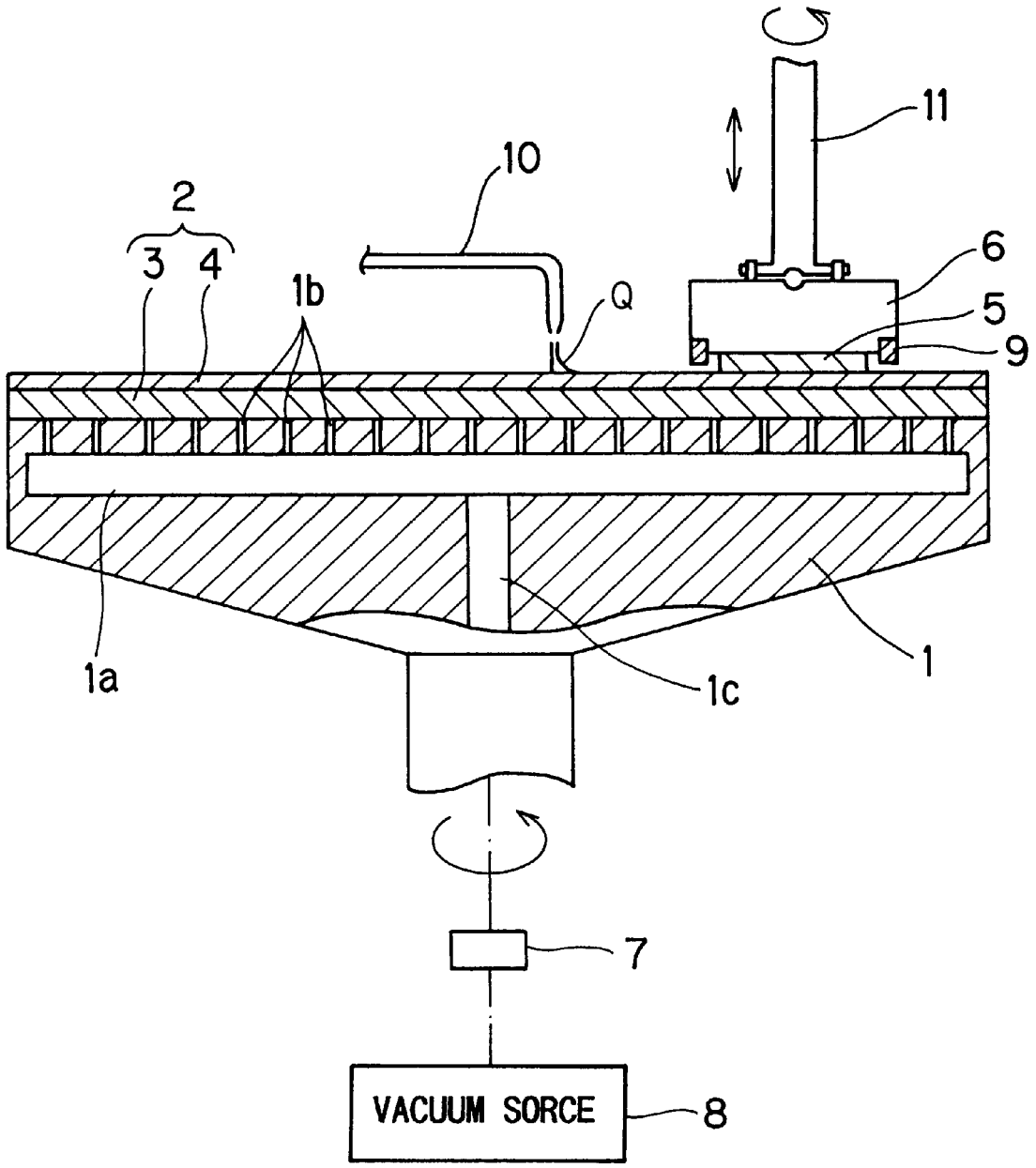
FIG. 1 is a cross-sectional view of a polishing apparatus having a cloth cartridge according to an embodiment of the present invention.

As shown in FIG. 1, a polishing apparatus comprises a turntable 1, a cloth cartridge 2 detachably exchangeably mounted on the turntable 1, and a top ring 6 for holding a semiconductor wafer 5 as a workpiece and pressing the semiconductor wafer 5 against the turntable 1. The cloth cartridge 2 comprises a disk-shaped base plate 3 and a polishing cloth 4 bonded to an upper surface of the base plate 3. The base plate 3 constitutes a cartridge base member.

The turntable 1 has a chamber 1*a* therein, and a number of vertical suction holes 1*b* which are open at the upper surface of the turntable 1 and communicate with the chamber 1*a*. The chamber 1*a* communicates with a vacuum source 8 through a vertical hole 1*c* formed in the turntable 1 and a rotary joint 7 coupled to a shaft of the turntable 1. Therefore, the cloth cartridge 2 can be fixedly mounted on the turntable 1 under vacuum developed by the vacuum source 8 when the suction holes 1*b* communicate with the vacuum source 8. The cloth cartridge 2 can be detached from the turntable 1 when vacuum in the suction holes 1*b* is broken, i.e., the pressure in the suction holes 1*b* is raised to ambient. The base plate 3 of the cloth cartridge 2 is made of alloy steel such as stainless steel, aluminum or plastics as a main component. The polishing cloth 4 of the cloth cartridge 2 is a commercially available polishing cloth which is normally used to polish semiconductor wafers. Examples of the polishing cloth are Suba 800 and IC-1000 manufactured by Rodel Products Corporation and Surfin xxx-5 and Surfin 000 manufactured by Fujimi Inc. The polishing cloth sold under the trade names Suba 800, Surfin xxx-5, and Surfin 000 is made of non-woven fabric composed of fibers bound together by urethane resin, and the polishing cloth sold under the trade name IC-1000 is made of polyurethane foam which is porous and has minute recesses or micropores in its surface.

The turntable 1 is rotatable about its own axis as indicated by an arrow by a motor (not shown) which is coupled to the turntable 1. The top ring 6 is coupled to a motor (not shown) and also to a lifting/lowering cylinder (not shown). The top ring 6 is vertically movable and rotatable about its own axis, as indicated by the arrows, by the motor and the lifting/lowering cylinder. The top ring 6 can therefore press the semiconductor wafer 5 against the polishing cloth 4 under a desired pressure. The semiconductor wafer 5 is attached to a lower surface of the top ring 6 under a vacuum or the like. A guide ring 9 is mounted on the outer circumferential edge of the lower surface of the top ring 6 for preventing the semiconductor wafer 5 from being disengaged from the top ring 6. An abrasive liquid Q is supplied through a supply pipe 10 onto the polishing cloth 4.

Figure 2A:
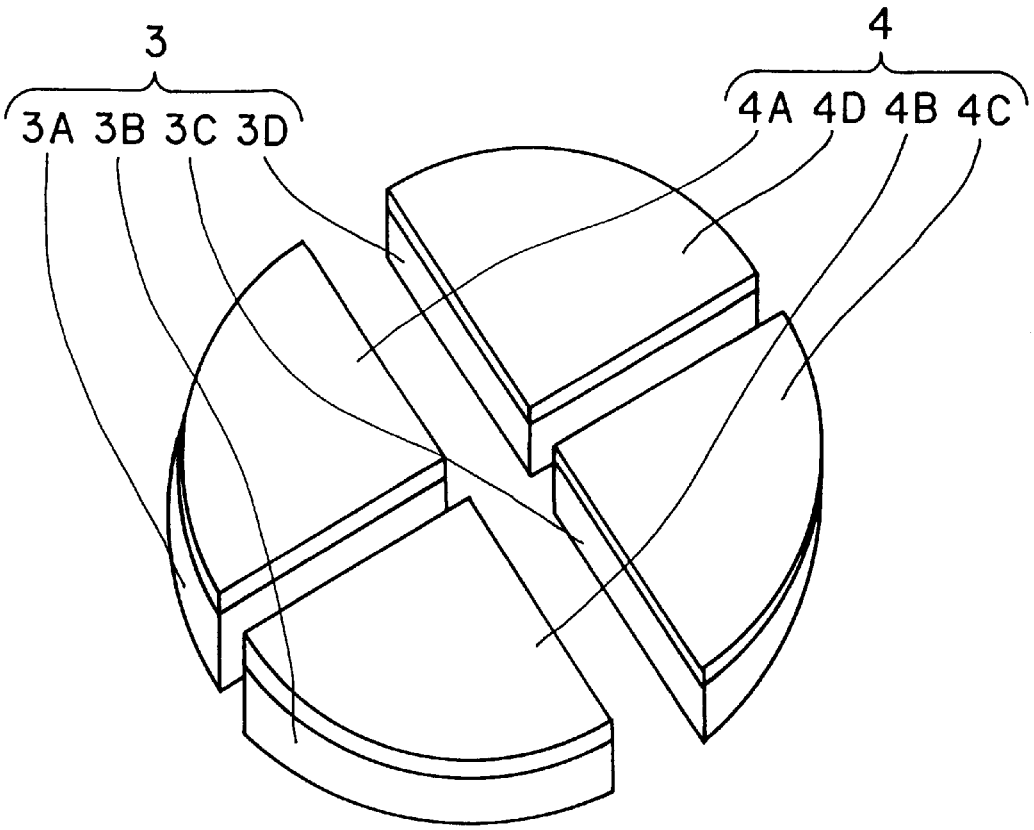
FIG. 2A is an exploded perspective view of a cloth cartridge shown in FIG. 1.
Figure 2B:
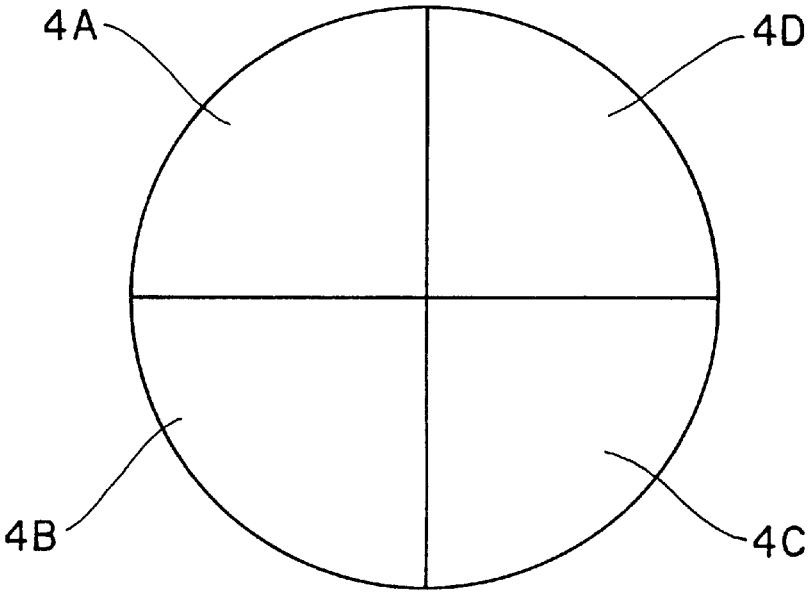
FIG. 2B is a plan view of a cloth cartridge shown in FIG. 1.

FIGS. 2A and 2B show the detailed structure of the cloth cartridge 2 shown in FIG. 1. As shown in FIGS. 2A and 2B, the cloth cartridge 2 is divided into four segments. Specifically, the base plate 3 comprises four sectorial base plate segments 3A, 3B, 3C and 3D, and the polishing cloth 4 comprises four sectorial polishing cloth segments 4A, 4B, 4C and 4D. The cloth cartridge 2 includes plural units, and each unit comprises one of the base plate segments 3A, 3B, 3C and 3D and one of the polishing cloth segments 4A, 4B, 4C and 4D bonded to one of the base plate segments 4A, 4B, 4C and 4D. The cloth cartridge 2 is detachably mounted on the upper surface of the turntable 1 under vacuum to form the uniform polishing surface shown in FIG. 1. The cloth cartridge 2 can be fixedly mounted on the turntable 1 or detached from the turntable 1 to form such uniform and uninterrupted polishing surface by the individual units each comprising one of the base plate segments 3A, 3B, 3C and 3D and one of the polishing cloth segments 4A, 4B, 4C and 4D. This structure of the cloth cartridges 2 allows the operation of replacement of the cloth cartridge 2 to be easy, and further allows the size of the bag for containing a cloth cartridge to be small. To be more specific, a bag having dimensions of 600 mm×600 mm or larger is required for containing the conventional cloth cartridge therein. However, in this embodiment, a bag having dimensions of 300 mm×300 mm is sufficient for containing the cloth cartridge 2 therein.

Figure 3:
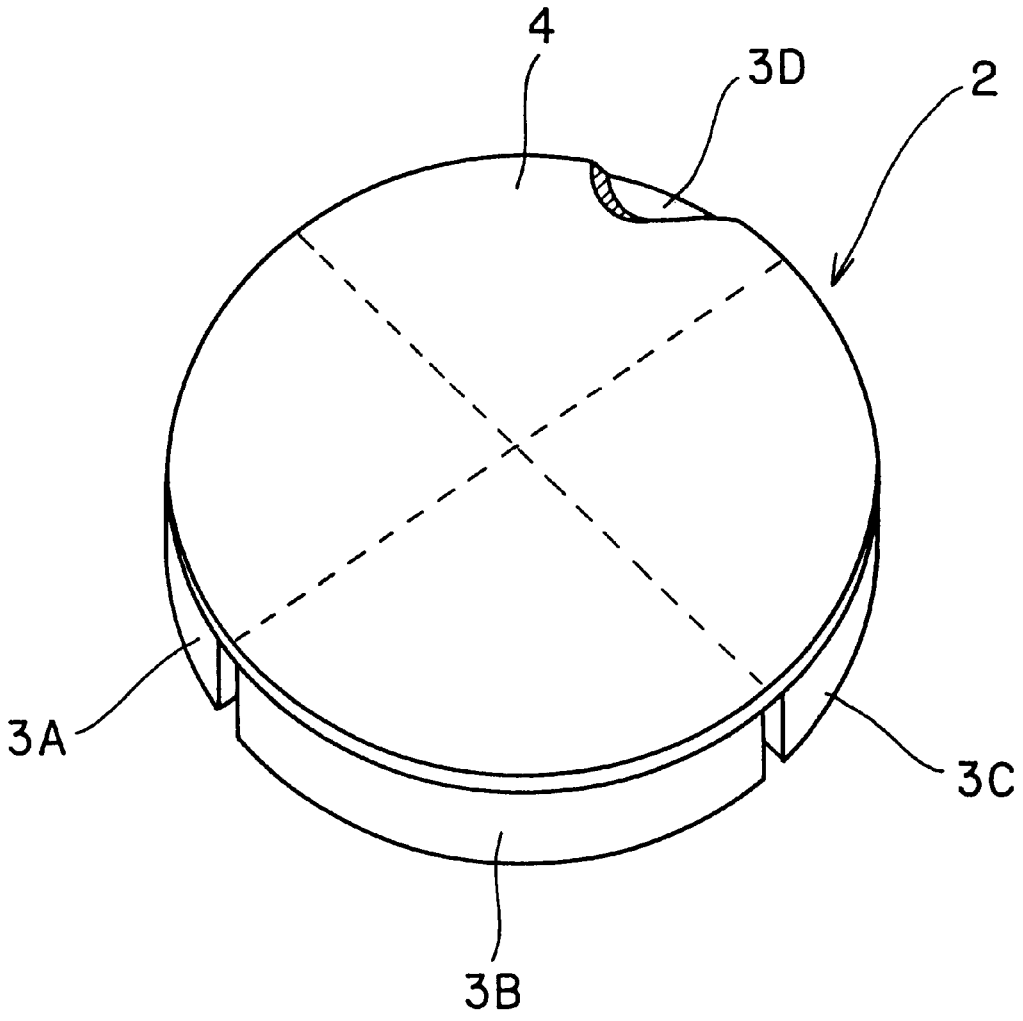
FIG. 3 is a perspective view of a cloth cartridge in the polishing apparatus according to another embodiment of the present invention.

FIG. 3 shows a cloth cartridge for a polishing apparatus according to another embodiment of the present invention. As shown in FIG. 3, the cloth cartridge comprises four sectorial base plate segments 3A, 3B, 3C and 3D, and a circular sheet of polishing cloth 4 bonded to the upper surfaces of the base plate segments 3A, 3B, 3C and 3D. The cloth cartridge 2 of this embodiment, when replaced, can be folded along dotted lines in half or fourth. That is, the cloth cartridge 2 can be folded into a more compact form by utilizing flexibility of the polishing cloth 4. Therefore, the cloth cartridge of this embodiment can be easily handled, and can be contained in a small-sized bag as in the embodiment of FIG. 2.

In the above embodiment, the cloth cartridge comprises a plurality of base plate segments and a polishing cloth bonded to the upper surfaces of the base plate segments, and can be folded by utilizing flexibility of the polishing cloth. However, the polishing cloth may comprise a plurality of polishing cloth segments, and a connector such as a hinge may be provided between two base plate segments adjacent to each other so that the cloth cartridge can be folded in half or fourth. Such divided cloth cartridge, it should may also include individual units each comprising a base plate segment and a polishing cloth segment, without folding, as described in the first embodiment.

As is apparent from the above description, the present invention offers the following advantages:

Since the cloth cartridge can be separated into a plurality of units or can be folded into a more compact form, the cloth cartridge can be easily handled at the time of replacement, and pollution of the environment of the clean room in which the polishing apparatus is installed can be prevented.

Although certain preferred embodiments of the present invention have been shown and described in detail, it should be understood that various changes and modifications may be made thereto without departing from the scope of the appended claims.

What is claimed is:

1. A polishing apparatus for polishing a surface of a workpiece, said apparatus comprising:

a turntable;

a cloth cartridge detachably exchangeably mounted on said turntable, said cartridge including a plurality of base member segments mounted on said turntable and having upper surfaces, said base member segments being discrete and separable from each other, and a plurality of polishing cloth segments bonded to said upper surfaces of respective said base member segments, said polishing cloth segments being arranged in contact to define a uniform polishing surface; and a top ring for holding a workpiece and pressing the workpiece against said polishing surface.

2. An apparatus as claimed in claim 1, wherein said base member segments are mounted by vacuum on said turntable to be fixedly positioned relative to each other.

3. An apparatus as claimed in claim 1, wherein each said base member segment is formed of one of alloy steel, aluminum and plastic as a main component.

4. An apparatus as claimed in claim 1, wherein each said base member segment and the respective said polishing cloth segment together define a separate unit that is detachably exchangeably mountable on said turntable.

5. An apparatus as claimed in claim 1, wherein each said base member segment and each said polishing cloth segment is sector shaped.

6. A cloth cartridge to be detachably exchangeably mounted on a turntable of a polishing apparatus for use in polishing a surface of a workpiece, said cartridge comprising:

a plurality of base member segments to be mounted on the turntable and having upper surfaces, said base member segments being discrete and separable from each other; and a plurality of polishing cloth segments bonded to said upper surfaces of respective said base member segments, said polishing cloth segments being arranged in contact to define a uniform polishing surface.

7. A cartridge as claimed in claim 6, wherein each said base member segment is formed of one of alloy steel, aluminum and plastic as a main component.

8. A cartridge as claimed in claim 6, wherein each said base member segment and the respective said polishing cloth segment together define a separate unit.

9. A cartridge as claimed in claim 6, wherein each said base member segment and each said polishing cloth segment is sector shaped.

10. A polishing apparatus for polishing a surface of a workpiece, said apparatus comprising:

a turntable;

a cloth cartridge detachably exchangeably mounted on said turntable, said cartridge including a plurality of base member segments mounted on said turntable and having upper surfaces, said base member segments being discrete and separable from each other, and a polishing cloth in the form of a sheet of material bonded to said upper surfaces of all of said base member segments; and a top ring for holding a workpiece and pressing the workpiece against said polishing surface.

11. An apparatus as claimed in claim 10, wherein said base member segments are mounted by vacuum on said turntable to be fixedly positioned relative to each other.

12. An apparatus as claimed in claim 10, wherein each said base member segment is formed of one of alloy steel, aluminum and plastic as a main component.

13. An apparatus as claimed in claim 10, wherein said polishing cloth is foldable along areas of juncture between adjacent said base member segments.

14. An apparatus as claimed in claim 10, wherein each said base member segment is sector shaped.

15. A cloth cartridge to be detachably exchangeably mounted on a turntable of a polishing apparatus for use in polishing a surface of a workpiece, said cartridge comprising:

a plurality of base member segments to be mounted on the turntable and having upper surfaces, said base member segments being discrete and separable from each other; and a polishing cloth in the form of a sheet of material bonded to said upper surfaces of said base member segments.

16. A cartridge as claimed in claim 15, wherein each said base member segment is formed of one of alloy steel, aluminum and plastic as a main component.

17. A cartridge as claimed in claim 15, wherein each said base member segment is sector shaped.

18. An apparatus as claimed in claim 15, wherein said polishing cloth is foldable along areas of juncture between adjacent said base member segments.

* * * * *

UNITED STATES PATENT AND TRADEMARK OFFICE

CERTIFICATE OF CORRECTION

PATENT NO. : 5,921,852

DATED : July 13, 1999

INVENTOR(S) : Norio KIMURA et al.

It is certified that error appears in the above-identified patent and that said Letters Patent is hereby corrected as shown below:

Title page, item [30], the Foreign Application Priority Data should read:

--Jun. 21, 1996 [JP] Japan .....8-181471--.

Signed and Sealed this

Eighteenth Day of January, 2000

*Attest:*

*Attesting Officer*

Q. TODD DICKINSON

*Commissioner of Patents and Trademarks*